United States Patent [19]

Bae

[11] 4,336,973

[45] Jun. 29, 1982

[54] FOLDING CLOTHES HANGER

[76] Inventor: Young Bae, 1947 S. Sherbourne Dr., No. 3, Los Angeles, Calif. 90034

[21] Appl. No.: 175,336

[22] Filed: Aug. 4, 1980

[51] Int. Cl.[3] ..... A47B 43/00; A47B 87/00

[52] U.S. Cl. ..... 312/199; 312/258; 312/262; 206/45.11; 108/111

[58] Field of Search ..... 312/238, 262, 258, 199, 312/200, 201, 204, DIG. 33; 108/41, 111, 38; 206/373, 45.11

[56] References Cited

U.S. PATENT DOCUMENTS

| | | | |
|---|---|---|---|
| 370,967 | 10/1887 | McNutt | 312/200 |
| 850,210 | 4/1907 | Cady | 312/199 |
| 949,502 | 2/1910 | Russell | 206/373 |
| 1,048,858 | 12/1912 | Murray | 312/258 |
| 1,286,588 | 12/1918 | Goodykoontz | 312/238 |
| 1,324,259 | 12/1919 | McElhinny | 312/258 |
| 1,521,650 | 1/1925 | Rudolph | 312/200 |
| 1,779,218 | 10/1930 | Schmalzgruber | 312/199 |
| 2,936,066 | 5/1960 | Meksula | 312/200 |
| 3,562,929 | 2/1971 | Emore, Jr. | 312/262 |
| 3,831,805 | 8/1974 | Yonce | 206/373 |

*Primary Examiner*—Victor N. Sakran
*Attorney, Agent, or Firm*—Charles H. Schwartz; Ellsworth R. Roston

[57] ABSTRACT

A folding clothes hanger including a first wall member, at least one clothes hanger mounted on the first wall member, a second wall member, at least one clothes hanger mounted on the second wall member, and a central post portion and with both the first and second wall members extending from and attached to the central post portion at angularly spaced positions and with at least one of the first and second wall members pivotably mounted to the central post portion for providing for at least a closed position with the first and second wall members lying substantially parallel to each other and an open position with the first and second wall members lying at an angular relationship to each other.

10 Claims, 5 Drawing Figures

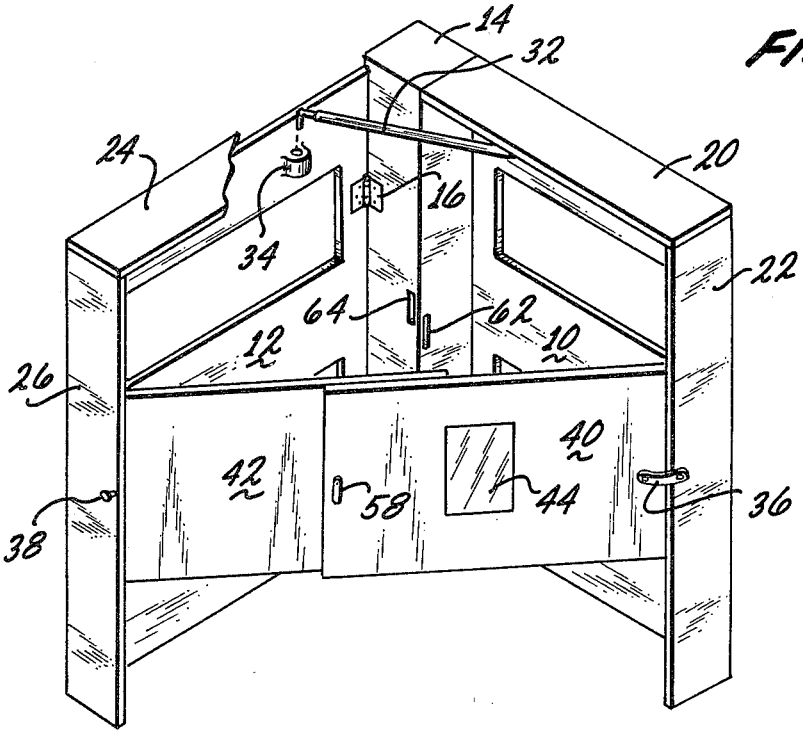
FIG. 3
FIG. 4
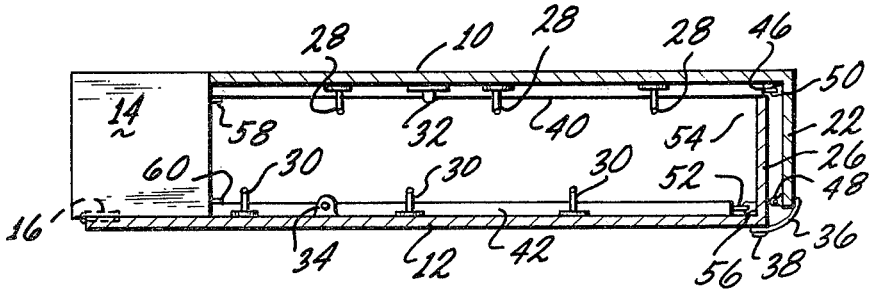
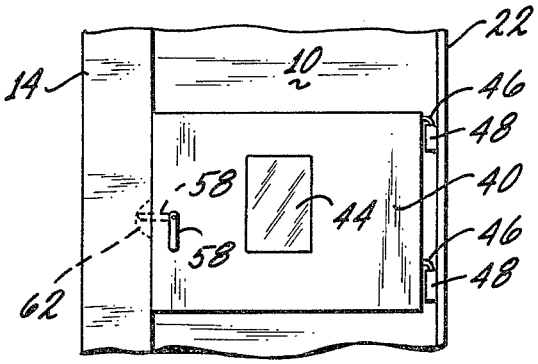
FIG. 5

FOLDING CLOTHES HANGER

The present invention relates to a folding clothes hanger. In particular, the folding clothes hanger of the present invention is formed as a portable piece of furniture which is usable as a clothes hanger, a screen, or it may be formed to provide for a small enclosure for trying on clothes.

The folding clothes hanger of the present invention may be easily moved to different positions and may be constructed to be light enough to be carried by a boy or girl. The clothes hanger of the present invention may be positioned in the corner of a room so as to take up a very small amount of space, or the clothes hanger may be positioned at a central position in a room so as to serve as a screen or room divider.

The folding clothes hanger of the present invention provides for a convenient receptacle for hanging clothes and with these clothes visible, such as for guests, and the clothes hanger of the present invention may also be used for drying wet clothes or for segregating one group of clothes from another.

The folding clothes hanger of the present invention may also include panel means so that a small enclosed space may be provided, such as for trying on clothes. All of the above advantages may be obtained in an economical fashion using the design of the folding clothes hanger of the present invention. It is to be appreciated that the clothes hanger may be constructed of a variety of different materials or a combination of materials, such as wood, aluminum, steel, plastic, etc.

The folding clothes hanger of the present invention includes a pair of wall members hinged relative to each other and extending from a central post section. Each wall member may include hangers for receiving clothes and each wall member may be cut out so as to reduce the weight. One or more rods may extend between the wall members to fix the wall members in a position where the wall members are at right angles to each other. Separate panel members may be pivotably mounted at one or more positions within the wall members. The panel members may be positioned in a recessed position and folded flat against a back wall of the wall member so that the entire structure may be folded together and be completely self contained. Alternatively, when the folding clothes hanger of the present invention is opened to a right angle position, the panel members may be pivoted from an outside position and may be pivoted to a number of different positions to provide for alternative configurations of the folding clothes hanger of the present invention.

A clearer understanding of the present invention may be had with reference to the following description and drawings wherein:

FIG. 3 is a front perspective view, partially broken away, of the folding clothes hanger of the present invention showing the panel members in a particular position;

FIG. 4 is a top folded view of the folding clothes hanger of the present invention; and FIG. 5 is a front view of a portion of the folding clothes hanger showing one panel member in a particular position.

As shown in the figures, the folding clothes hanger of the present invention includes a first wall member 10 and a second wall member 12. Both wall members may have cut-out portions so as to reduce their weight. The first wall member 10 extends from a central box-like post portion 14. The first wall member may be permanently connected to one side of the central post portion 14. The second wall member 12 is hinged to another side of the central post portion 14 by hinges 16 and 18 to be angularly spaced from the first wall member.

Figure 1:
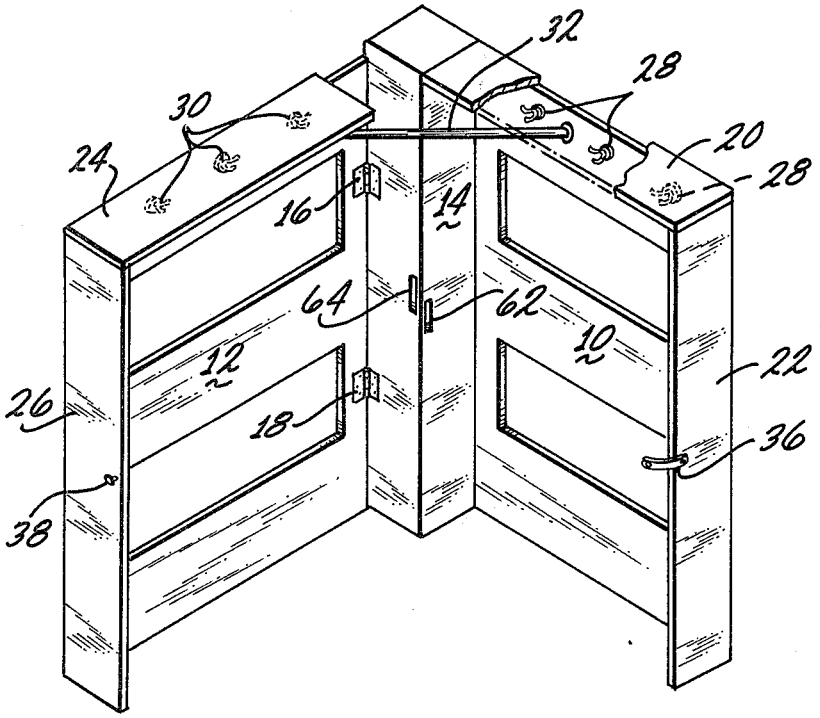
FIG. 1 is a front perspective view of the folding clothes hanger of the present invention without the panel members in position.

The first wall member may also include a top wall portion 20 and a side wall portion 22. Similarly, the second wall member may include a top wall portion 24 and a side wall portion 26. A plurality of clothes hangers 28 are supported by a first wall member 10 and a second plurality of clothes hangers 30 are supported by the second wall member 12. It is to be appreciated that any particular number of clothes hangers may be used and the particular position of the hangers can be varied. A rod member 32 extends between the wall members 10 and 12 to fix the wall members at right angles to each other. A right angle end portion of the rod member 32 may be received in an eye member 34, as shown in FIG. 3, when it is desired to maintain the wall members in a right angle configuration as shown in FIGS. 1 and 3. The rod member 32 may be disengaged from the eye member 34 to lie in a downward position so that the wall member 12 may be closed to provide for the clothes hanger in the folded position, as shown in FIG. 4. A hook 36 and latch 38 may be used to lock the clothes hanger in the closed position as shown in FIG. 4.

The folding clothes hanger of the present invention may also include a pair of pivoted panel members 40 and 42. One or both of the panel members may include a mirror portion as shown by mirror portion 44 on panel member 40. The panel members 40 and 42 are supported for pivotable movement from the side wall portions 22 and 26 at one of two fixed positions. Specifically, panel member 40 includes two hook members 46 that are received in two eye members 48 to allow for pivotable movement of the panel member 40 at a first pivotal position along the side wall portion 22 of the wall member 10. The hook members 46 may also be received in a second pair of eye members 50 located at a second pivotal position along the side wall portion 22.

In a similar fashion, the panel member 42 includes hook members 52 which may be received in eye members 54 or 56 located at two positions along the side wall portion 26. It is to be appreciated that other means may be used for providing for the pivotable mounting of the panel members and that more than two positions may be used or even a continuous positioning may be used.

Figure 2:
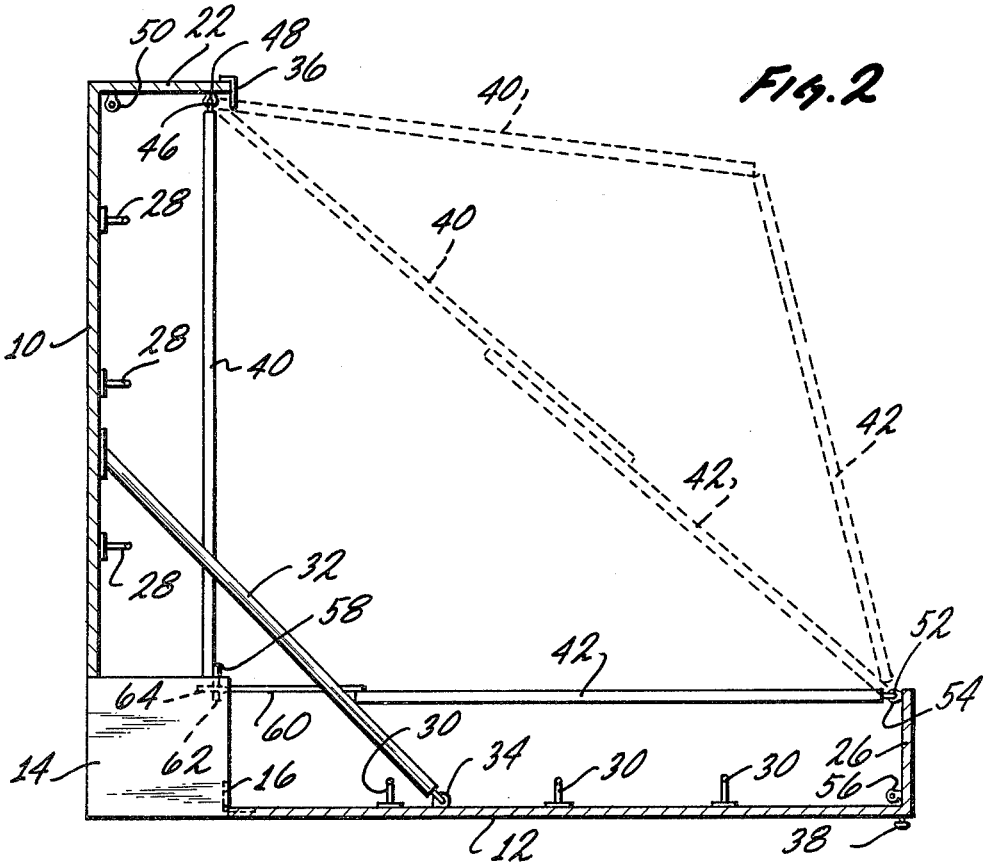
FIG. 2 is a top cross-sectional view of the folding clothes hanger of the present invention showing the panel members in a number of different positions.

The pivotable mounting of the panel members 40 and 42 at different positions allows for a great variety of positioning of the panel members 40 and 42. For example, as shown in FIG. 2, the panel members may be positioned to lie parallel to the wall members 10 and 12. This allows for a small enclosed space in which clothes may be hung and provides for protection for the clothes. Hook members 58 and 60 which are received in slots 62 and 64 allow for the panel members 40 and 42 to be fixed in the position shown in FIG. 2 in solid lines. The hook member 60 is longer and the panel member 42 is spaced from the central post portion 14 so that, as shown in FIG. 4, the panel member 42 will fit within the clothes hanger when in the folded position. It is to be appreciated that the panel member 42 may be made longer and with storage provided other than as shown in FIG. 4.

In FIG. 2, two alternate positions for the panel members 40 and 42 are shown in dotted portion. FIG. 3 shows the panel members in the middle one of the alternate positions. It is to be appreciated, of course, that any number of arrangements for the panel members 40 and 42 may be provided and that the particular sizes and shapes of the panel members may be altered. As shown in the dotted positions for the panel members in FIG. 2, the panel members may provide for a small enclosed space so that the folding clothes hanger may serve as a dressing room for trying on clothes or for other purposes.

The clothes hanger of the present invention may be, of course, placed in a corner position of a room or may be placed in a middle position of a room so as to serve as a screen or room divider. When the folding clothes hanger of the present invention is not in use, then the panel members 40 and 42 may be moved to their inner pivot positions and the wall members 10 and 12 may be folded together to provide for the closed compact structure shown in FIG. 4.

Although the present invention has been shown with reference to a particular embodiment, it is to be appreciated that various adaptations and modifications may be made and the invention is only to be limited by the appended claims.

I claim:

1. A folding clothes hanger including a first wall member having a particular width, at least one clothes hanger mounted on the first wall member at an upper position along the width, a second wall member having a particular width, at least one clothes hanger mounted on the second wall member at an upper position along the width, and a central post portion for supporting the wall members at physically spaced positions and with both the first and second wall members extending from and attached to the central post portion at angularly spaced positions and with at least one of the first and second wall members pivotably mounted to the central post portion for providing for at least a closed position with the first and second wall members lying substantially parallel to and spaced from each other and an upright open position with the first and second wall members lying at an angular relationship to each other and with the clothes hanger supported in the upright open position by the wall members.

2. The folding clothes hanger of claim 1 wherein the central post portion has a square cross section and with the first wall member attached to a first side of the central post portion and with the second wall member attached to a second side of the central post portion at right angles to the first side.

3. The folding clothes hanger of claim 1 wherein at least one of the wall members includes a top wall portion and a side wall portion and with the top wall portion and the side wall portion enclosing the folding clothes hanger when in the closed position.

4. The folding clothes hanger of claim 1 wherein both wall members include a top wall portion and a side wall portion and with the top wall and side wall portions of one of the wall members received within the top wall and side wall portions of the other of the wall members when the folding clothes hanger is in the closed position.

5. The folding clothes hanger of claim 1 including a detachable rod member for extending between the wall members when in the open position for locking the wall members in the open position.

6. The folding clothes hanger of claim 1 additionally including a first panel member pivotably mounted to the first wall member along the width of the first panel member at a position remote from the attachment of the first panel member to the central post portion and a second panel member pivotably mounted to the second wall member along the width of the second panel member at a position remote from the attachment of the second panel member to the central post portion for providing for at least a closed position with the first and second panel members lying parallel to the respective first and second wall members and an open position with the first and second panel members lying at angular relationships to the respective first and second wall members and forming an enclosed space with first and second wall members.

7. The folding clothes hanger of claim 6 additionally including latch means for latching the panel members to the central post portions with the panel members in the closedposition.

8. The folding clothes hanger of claim 6 wherein the first and second wall members each include a side wall portion and with the first and second panel members pivotably mounted to the respective side wall portions.

9. The folding clothes hanger of claim 8 wherein the panel members are pivotably mounted at at least two positions along the width of the side wall portions and with the panel members mounted at a first position spaced from the wall members for providing the enclosed space between the panel members and the wall members and mounted at a second position adjacent the wall members for providing storage of the panel members when the wall members are in the closed position.

10. The folding clothes hanger of claim 9 additionally including latch means for latching the panel members to the central post portion with the panel members in the first position spaced from the wall members and in the closed position with the panel members substantially parallel to the wall members.

* * * * *